US011252503B2

(12) United States Patent
Van Noort et al.

(10) Patent No.: US 11,252,503 B2
(45) Date of Patent: Feb. 15, 2022

(54) ASSEMBLY COMPRISING A SENSOR IN A SPOUT

(71) Applicant: Sonion Nederland B.V., Hoofddorp (NL)

(72) Inventors: Friso Van Noort, Hoofddorp (NL); Raymond Mogelin, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 17/150,333

(22) Filed: Jan. 15, 2021

(65) Prior Publication Data

US 2021/0243521 A1 Aug. 5, 2021

(30) Foreign Application Priority Data

Jan. 31, 2020 (EP) ..... 20154888

(51) Int. Cl.
*H04R 25/00* (2006.01)
*H04R 1/34* (2006.01)

(52) U.S. Cl.
CPC ..... *H04R 1/345* (2013.01); *H04R 25/604* (2013.01); *H04R 25/652* (2013.01); *H04R 2225/023* (2013.01)

(58) Field of Classification Search
CPC .. H04R 1/1041; H04R 1/1016; H04R 1/1058; H04R 29/001; H04R 2460/11
See application file for complete search history.

(56) References Cited

U.S. PATENT DOCUMENTS

| | | | | |
|---|---|---|---|---|
| 7,995,782 | B2 | 8/2011 | Saltykov | |
| 2006/0251282 | A1* | 11/2006 | Kaoh | H04R 1/083 381/381 |
| 2010/0020993 | A1* | 1/2010 | Poh | H04R 25/505 381/314 |
| 2015/0092952 | A1 | 4/2015 | Sudo et al. | |

FOREIGN PATENT DOCUMENTS

| | | | |
|---|---|---|---|
| EP | 2091267 | A1 | 8/2009 |
| EP | 2166779 | A2 | 3/2010 |
| EP | 3160157 | B1 | 9/2018 |
| EP | 3726855 | A1 | 10/2020 |
| WO | WO-2015/026043 | A1 | 2/2015 |

OTHER PUBLICATIONS

Extended European Search Report for European Patent Application No. 20154888 dated Jun. 18, 2020.

* cited by examiner

*Primary Examiner* — Amir H Etesam
(74) *Attorney, Agent, or Firm* — Harness, Dickey & Pierce, P.L.C.

(57) ABSTRACT

An assembly of a sound generator having a sound output, a spout connected to the receiver, the spout having a sound channel having a first opening connected to the sound output and a second opening from which sound may be output. The spout has one or more third openings blocked by fastening portions of a dome, and a sensor positioned in the sound channel at the third opening(s). Sound may pass the sensor in the sound channel while travelling in the third opening(s). The assembly may be a personal hearing instrument and the sensor may be a microphone.

15 Claims, 3 Drawing Sheets

ASSEMBLY COMPRISING A SENSOR IN A SPOUT

RELATED APPLICATIONS

This application claims priority to European Patent Application No. 20154888.0 filed on Jan. 31, 2020, the entire contents of which are incorporated herein by reference.

The present invention relates to an assembly of a sound generator with a spout and a sensor provided in the spout. Sound generators with sensors are particularly interesting when provided in or at an ear of the person. The sensor may then be a microphone for determining a sound pressure between the sound generator and an eardrum. Alternatively, the sensor may be a sensor configured to determine an activity of or a parameter of a person wearing the assembly.

Relevant technology may be seen in EP3160157, U.S. Pat. No. 7,995,782, WO2015/026043, EP2091267, US2015/092952, EP2166779 and European patent application with application number EP19169292.0.

In a first aspect, the invention relates to an assembly according to claim 1.

In the present context, an assembly is a collection of elements which may or may not be attached to each other. Preferably, the sound generator, spout and sensor are, at least indirectly, connected to each other, so that the assembly may be easily manipulated, such as during production or use.

The assembly may be for multiple purposes. A desired purpose is that of, and/or the assembly may be, a hearing device, a hearable, a portable audio device, an earphone, an earbud, a personal hearing instrument, such as a hearing aid, or the like, where the assembly may be designed and dimensioned to be provided in or at an ear or ear canal of a person or user.

The sound generator, which in the hearing industry terminology usually is called a receiver, preferably is a so-called miniature receiver, which is a sound generator with a largest dimension of no more than 10 mm, such as no more than 8 mm, such as no more than 6 mm or no more than 5 mm. In one situation, the sound generator housing may have a volume of no more than 100 $mm^3$, such as no more than 70 $mm^3$, such as no more than 50 $mm^3$, such as no more than 30 $mm^3$. Miniature sound generators may be used in hearing aids, hearables or personal hearing devices, such as earphones or the like.

The sound generator may be based on any desired technology, such as moving magnet, moving coil, balanced armature, electret technology, MEMS technology, piezo technology or the like. The sound generator is preferably configured to receive a signal, such as an electrical signal, and output a sound or vibration with corresponding frequency contents, at least within a desired frequency interval.

The sound generator usually has a diaphragm defining, with an inner surface of the receiver housing, the first chamber in the receiver housing. Often, another chamber is defined at least partly by the other side of the diaphragm and the inner surface of the housing.

The sound output often extends from inside of the receiver housing and to the outside thereof, such as from the first and/or other chamber, so that sound generated by the diaphragm may escape the receiver housing via the sound output.

The sound output is provided in a housing wall part of the receiver housing, typically a flat or plane wall part of the receiver housing.

A spout connected to the sound generator, which is often called a receiver. In this context, the spout may be physically connected, such as rigidly connected, to the receiver. In addition, or alternatively, the connection may be configured to allow sound generated by the sound generator to reach the spout and exit the assembly through or via the spout. In some embodiments, the spout may be an integral part of the receiver, such as a part of a housing of the receiver. Often, however, the spout is a separate part from the receiver and is attached to the receiver, such as by gluing, press/click fitting, soldering, melting or the like. The spout may be a part of an element having a portion fitting the outside of the sound generator, so that the spout may be attached to the sound generator via this portion. Actually, the spout may form part of, such as an integral part of, an assembly housing inside which the sound generator may be provided.

The spout has or defines a sound channel therein. The sound channel has a first and a second opening. Additional openings may be provided.

Often, the spout defines the sound channel as an inner space by walls or wall parts.

Often, the spout has a cross section, in a plane perpendicular to a longitudinal axis of the spout, which is smaller than a cross section, such as a mean cross section, of the sound generator when projected on to the plane. In some situations, then projected on to the plane, the outline of the spout may be completely within an outline of the sound generator.

The first opening is connected to the sound output so that sound output from the sound output may enter the spout and/or the sound channel and be guided thereby. The connection may be the sound output being configured to guide the sound toward the spout and/or the sound channel. Additionally, or alternatively, the connection may be positioned so as to be able to receive sound output from the sound generator, such as along a sound output direction from the sound output of the sound generator. The second opening may be defined by portions of the spout engaging the sound generator so that sound cannot escape the sound channel at the first opening.

The second opening may be useful for outputting the sound entering the first opening.

The sound channel extends between the first and second opening. The sound channel may be straight, so as to have a straight longitudinal axis, or bent/curved, so as to have a bent longitudinal axis. The sound channel may have the same or a varying inner cross-sectional shape or area. In one situation, the sound channel is straight and has a circular cross-sectional shape.

The sound channel of the spout is configured to guide sound away from the sound generator. This may be obtained by directing the sound channel of the spout in a direction away from the sound generator. Additionally, or alternatively, the second opening, from which sound from the sound generator may output the spout, may be positioned and directed so that sound output from that opening travels in a direction away from the sound generator.

Clearly, the direction away from the sound generator may be a direction not towards the sound generator. Sound may be directed directly away from the sound generator or in any direction where the sound, as it travels over time, obtains an increasingly large distance to the sound generator.

The sensor is provided in the sound channel. Preferably, the sensor is positioned between the first and second openings. Alternatively, a portion of the sensor may extend out of the sound channel, such as out of the second opening.

Preferably, the sensor has a housing. The sensor preferably is a miniature device, such as a device with an overall volume of 10 $mm^3$ or less, such as 8 $mm^3$ or less, such as 6 $mm^3$ or less, such as 4 $mm^3$ or less, such as 3 $mm^3$ or less.

The sound channel allows sound transport around the sensor, so that sound from the sound generator may be output via the second opening.

Thus, the sensor preferably fits inside the sound channel with room to spare.

Then, at positions along the longitudinal axis of the sound channel at which the sensor is provided, the outer contour of the sensor is provided inside the inner contour, in a cross section of the sound channel perpendicular to the longitudinal axis, of the sound channel. Space or area may exist within the cross-sectional contour of the sound channel outside of the outer contour of the sensor.

According to the invention, the spout has one or more third openings between the first opening and the second opening. In this context, a third opening may be a channel or opening through the spout so that sound would be able to escape the spout through the third opening. The cross-section at the opening may comprise fully therein the general cross-section where the difference may be created by or may form the third opening(s).

The sensor is positioned in the sound channel at the third opening(s). Thus, sound may travel along the sensor inside the third opening(s). Then, in the situation where the sound channel has a general internal cross-section, such as if it is tube-shaped, and when the sensor would block that cross-section, the sound would be able to pass the sensor by travelling in the third opening(s).

It is remembered that neither the sound channel nor the sensor need to have the same cross-sectional inner/outer shape along its length. Thus, in the situation where the sensor, at one position along the sound channel, would block the general cross-section of the sound channel, the third position(s) could be positioned to allow sound to pass the sensor. Alternatively, the outer cross section of the sensor may fit inside an inner cross-section of the sound channel where the opening(s) merely provide more space for the sound when passing the position of the sensor.

The dome has a fastening portion engaging the spout and blocking the third opening(s). The fastening portion may be configured to attach or fix the dome to the spout. Often, the dome is used for fixing or attaching the assembly in an ear canal of a person, so that the dome will act to fix the spout, sound generator and sensor in relation to the ear canal.

The fastening portion may be configured to engage an outer surface portion of the spout, such as an outer surface portion of the spout at which the third opening(s) are provided. The third opening(s) open from the sound channel to the surroundings and are blocked by the fastening portion. The fastening portion may form, outside of the spout or spout cross-section a closed space into which sound may travel, but not escape to the surroundings, from a third opening. Alternatively, the fastening portion may, at a third opening, be provided flush with a general, outer cross-section of the spout so that sound is not allowed to travel outside of this outer cross-section at the third opening.

In this context, "blocking" a third opening will mean that sound will not to any significant degree be able to escape a third opening via any openings in the fastening portion or an interface between the spout and the fastening portion. Sound may escape by travelling through the fastening portion material, as sound travels through material but is attenuated in the process. It may be desired that any sound escaping the third opening via the dome, or between the spout or the dome, is attenuated at least 3 dB, such as at least 6 dB.

It may be desired that sound may pass the position at the sensor while travelling in the third opening(s). Thus, it may be preferred that, along a longitudinal axis of the sound channel:

the sensor is positioned between a first position and a second position and a third opening is positioned between a third position and a fourth position, wherein the first and second positions are provided between the third and fourth positions.

The positions may be the extreme positions between which all portions of the sensor/opening are provided. The positions and portions may be projected on to the axis. The longitudinal axis may be an axis along a direction of sound propagating in the sound channel. The longitudinal axis may be an axis of symmetry of the sound channel. The longitudinal axis may be straight or curved.

It may be sufficient that only one of the first and second positions are provided between the third and fourth positions, such as if sound is able to pass between the sensor and sound channel walls at the other of the first and second positions.

In one embodiment, the sensor is generally box-shaped with at least 4 at least substantially plane surfaces and wherein sound passages extend at least 2 of the at least 4 at least substantially plane surfaces. In this context, "box-shaped" will mean that the element has three sets of pair-wise parallel sides. Often, corners and edges are rounded. Often, the sound channel has, in a plane perpendicular to its longitudinal axis, a round or smooth shape or outline. Thus, a box-shaped element will not easily seal toward the walls. However, allowing sound to pass the sensor on multiple sides will allow sound to pass between the straight side and the curved side. The filtering and attenuating effect caused by the sensor in the sound path is a.o. defined by the overall area taken up or blocked by the sensor. The actual shape of this area is of less importance. Thus, many small channels will allow sufficient sound to pass the sensor.

Another parameter is the length of the sound channel along which the blocking or attenuating takes place.

Therefore, it may be desired to put constraints on the space available for the sound around the sensor. In one example, if at least 15% of the cross-sectional area of the sound channel, at the sensor, is left open, the sensor may have a length of 2.4 mm or more. If the sensor has a length of 5 mm, 30% or more of the cross-sectional area may be left open to ensure a sufficiently low impact on especially the high frequency properties of the sound channel.

In one embodiment, one or more sound passages are provided in the sound channel around the sensor. Then, the above considerations are relevant for these passages. When multiple passages are provided, the above area is the combined area, in the cross section, of all passages.

In general, it may be desired that at least 5%, such as at least 7%, such as at least 10%, such as at least 12%, such as at least 15% of the cross-sectional area of the sound channel, at the sensor, is left open. In addition, it may be desired that the sensor takes up, in the sound channel, no more than 8 mm, such as no more than 6 mm, such as no more than 4 mm, along the length of the longitudinal axis of the sound channel.

In one embodiment, the sensor is generally box-shaped and has a longitudinal axis at least substantially parallel to a longitudinal axis of the spout.

In one embodiment, the sensor is a microphone having a sound input. In that embodiment, the second opening may also act to allow sound from outside of the assembly to enter the sound channel and enter the microphone.

The microphone may have a microphone housing having a microphone housing wall part comprising the sound input. The microphone housing usually has an inner volume into which the sound input opens from the outside of the housing. Any technology may be used in the microphone housing to convert the sound received into an output signal.

As is the often situation in the sound generator, the sound input may be provided in a substantially flat or plane wall portion. Other shapes may be desired of the wall portion or the microphone.

Then, it may be desired that a distance of at least 2 mm, such as at least 3 mm, such as at least 4 mm, such as at least 5 mm, such as at least 6 mm, exists, along the sound channel, between the sound output and the sound input.

This distance may be a Euclidian distance or a distance along the longitudinal direction or axis of the sound channel. The position of an opening may be the portion of the longitudinal axis intersecting a plane perpendicular to the longitudinal axis in which the opening or a part thereof is seen.

Also, it may be desired that the sound inlet is much closer to the second opening than the sound outlet, such as when a first distance exists, along the sound channel, from the second opening to the sound input and a second distance exists, along the sound channel, between the second opening and the sound output, wherein the second distance is at least 2 times, such as at least 3 times, such as at least 4 times, such as at least 5 times, such as at least 10 times, the first distance.

In one embodiment, the second distance is at least 6 mm longer than the first distance. Then, at all longitudinal positions of the spout where the sensor is present, the sensor may cover an area of no more than 95%, such as no more than 90%, such as no more than 80%, such as no more than 75% of an inner cross sectional area of the spout at the position. In this situation, the sound channel may be sufficiently open for sound, such as to have no excessive impact on frequencies below 6 kHz. Often, it is desired that the presence of the sensor in the sound channel does not attenuate sound in the 100-5 kHz range by less than 9 dB, such as less than 6 dB, such as less than 3 dB.

Alternatively or additionally, the first distance may be no more than 3 mm, such as no more than 2 mm, such as no more than 1 mm, as it may be preferred to prevent or make difficult the traveling of sound from the sound generator into the microphone.

In one embodiment, the spout comprises at least two separate sound transport channels, one sound transport channel extending from the second opening to the sound output and another of the sound transport channels extending from the second opening to the microphone. Then, mixing of the sound from the sound generator and that for the microphone may be prevented along a portion of the length of the sound channel or along the full length of the sound channel where both types of sound exist.

Then, the spout may comprise sound passage isolation means for defining the two sound transport channels.

Clearly, in one embodiment, the sound transport channels may be defined as one sound transport channel extending inside the other, such as if the sound for the microphone is guided inside a tube inside the sound channel, where the sound from the sound generator may be transported in the sound channel but outside of the tube.

Naturally, the sound transport channels need not be defined all the way to the second opening. A distance may exist from an end of a sound transport channel to the second opening, if desired.

The sound transport channel for guiding the sound for the microphone naturally need not extend over the distance in the sound channel taken up by the microphone, nor between the microphone and the first opening.

In a preferred embodiment, the assembly further comprises a dome attached to the spout.

In this connection, a dome may be a resilient element configured to be provided in an ear canal and to more or less fix the sound generator in relation to the ear canal.

Thus, a dome usually has a central portion configured to engage the spout and one or more outwardly flaring portions configured to engage the ear canal. A dome often is made of a resilient material, such as a polymer, silicone, rubber or the like, which may bias against the ear canal and provide sufficient force to maintain the sound generator in a desired position in relation to the ear canal even when the user moves—and with a force sufficiently low to not provide excessive discomfort.

The outwardly flaring portion(s) may be a single dome-shaped portion, such as an element with a mushroom-shaped or umbrella-shaped surface. Alternatively, the dome may comprise a number of individual elements each extending outwardly in different directions. Domes are well-known and any type of dome may be used.

When a sensor is provided which outputs/emits signals, such as radiation, or is configured to receive such signals, the dome or the portion thereof close to the sensor may be transmissive or translucent so such signals/radiation.

Often, the dome has a portion configured to engage the spout, such as configured to receive the spout. The dome may have a central portion and outwardly flaring portion(s), where the central portion is configured to engage the spout. Often, the spout is received in the central portion which is bore-shaped. The spout may extend out of the bore. Alternatively, the second opening is provided in the bore, where the bore than forms a third opening from which the sound from the sound generator is output. In that situation, the above considerations related to distances may be equally valid in relation to the third opening instead of the second opening, where the position of the third opening is then taken along an extension of the longitudinal axis of the spout and along a longitudinal axis of the bore. Also, the dome may then comprise a separating element continuing a separation of the sound channel into sound transport channels.

When the dome and/or spout has separate sound transport channels, it may be desired that the openings of the sound transport channels have a separation of at least 2 mm, such as at least 3 mm, such as at least 4 mm, as this assists in ensuring that not too much sound from the sound generator enters the microphone.

The spout may then have an outer surface configured to engage the dome. The spout hereby may have one or more indentations or protrusions, such as a circumferential ridge, configured to engage similar structures of the dome to allow engagement between the spout and the dome and make displacement and disengagement between them difficult.

In one embodiment, the assembly further comprises an assembly housing, the sound generator being provided in the assembly housing and the spout being part of the assembly housing. The spout may be attached to the housing or may be made monolithic with the housing or a portion thereof.

Clearly, the assembly may comprise additional elements. Often, such assemblies also comprise a power source, such as a battery or fuel cell, as well as, or alternatively, a processor, storage of the like. A processor may be provided for receiving an output of the sensor. This output may simply be output of the assembly, such as if transmitted to an external element for analysis or the like. The sensor may determine a parameter, such as a pulse, of the user, and this signal may be output for display and/or analysis by an external element, such as a mobile telephone.

Alternatively, the output of the sensor may be used for adapting the sound from the sound generator. Thus, a processor may be provided, in the assembly of remotely therefrom, which receives the output of the sensor and generates a signal for the sound generator or for use in the generation of a signal for the sound generator.

If the processor is remote, the assembly may comprise suitable communication means, such as plugs and cables or antennas for communicating with the remote processor.

In one situation, the sensor is a microphone configured for sensing sound from a space between the dome and an ear drum of the user. This signal may be fed back to a processor for use in generation of the signal for the sound generator.

Alternatively, the output of the sensor may be used for indicating the integrity of the assembly. When used in an ear canal, the assembly, such as the second/third opening may be fully or partly clogged by ear wax. This may be detectable from the output of a the sensor when being a microphone. Then, this signal may be used for indicating replacement or cleansing of the assembly.

A second aspect of the invention relates to a Receiver in the Canal (RIC) element comprising an assembly according to the first aspect of the invention. A RIC is an element configured to be provided in or at an ear canal of a person. Often, a RIC is connected to another elements, often called a BTE from which signals for the sound generator are received. Also, the signals from the sensor may be fed to the BTE which usually is larger and thus the preferred position for providing e.g. a processor and a battery.

A third aspect of the invention relates to a personal hearing device comprising an assembly according to the first aspect of the invention.

Clearly, all aspects, embodiment, situations, features and the like of the first aspect are equally valid for this and the below aspect of the invention.

Often, personal hearing devices comprise, in addition to a sound generator, power sources, such as batteries or fuel cells, processors, additional sensors, or the like. A personal hearing device usually has an outer housing in which the sound generator and other elements are positioned. This housing may be dimensioned, shaped or configured to be positioned on, at or in an ear or ear canal of a person.

A last aspect of the invention relates to a method of providing an assembly according to the first aspect of the invention, the method comprising:

providing a sound generator having a sound output, attaching a spout to the sound generator at the sound output, and providing a sensor in the spout.

In this connection, a sound generator may be a standard sound generator, such as any sound generator produced by Sonion. Often, sound generators themselves have no spout but have a sound outlet being an opening in a generally box-shaped housing often having rounded edges and corners.

The sensor may be attached to the spout if desired. This attachment may be a press fitting, a click fitting, gluing or the like. Alternatively, positioning members or fastening members may be provided in the spout for attaching the sensor to the spout. Such positioning members preferably are chosen so as to not themselves take up too much space in the sound channel. One manner of attaching a sensor in a sound channel would be to use an acoustically transparent reticulated foam such as described in European patent application with application number EP19169292.0.

Clearly, additional elements may be provided, such as processor or the like for receiving a signal from the sensor and potentially providing a signal for the sound generator.

The invention also relates to an assembly of:

a sound generator having a sound output, a nozzle connected to the sound generator, the nozzle having a sound channel having a first opening connected to the sound output and a second opening, and a sensor positioned in the sound channel.

This aspect of the invention may be combined with any of the above embodiments, aspects, situations and the like.

In the following, preferred embodiments are described with reference to the drawing, wherein.

Figure 1:
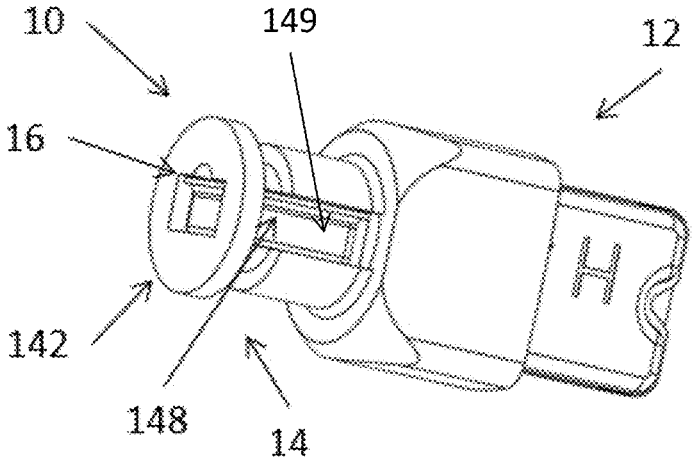
FIG. 1 illustrates a first assembly according to the invention.

In FIG. 1, an assembly 10 is illustrated comprising a sound generator 12, called a receiver in hearing aid terms, and a spout unit comprising a spout 14 attached to the receiver. Usually, the receiver is spoutless, so that it has a box-shaped housing with rounded corners and an opening 122 therein for outputting sound from the receiver.

Figure 2:
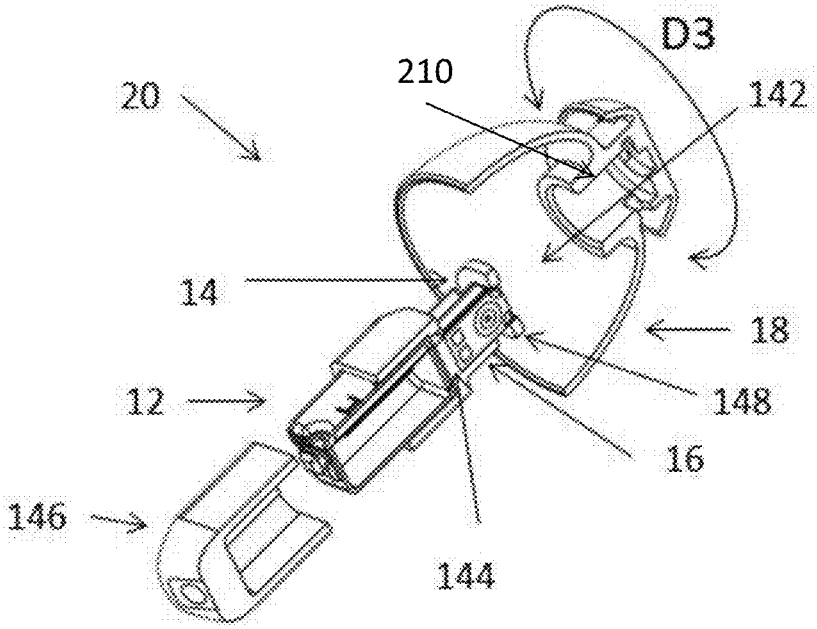
FIG. 2 illustrates a second assembly according to the invention.

The spout 14 has a sound channel 148 having a first opening 144 for receiving the sound from the receiver and an opening 142 for outputting the sound. Usually, the spout is used for connecting the receiver to a dome (see FIG. 2) or other structures, such as sound guides and/or an outer housing. Thus, the spout unit is usually attached to or fixed in relation to the receiver.

In the sound channel 148 of the spout, a sensor 16 is provided. The sound channel 148, however extends around the sensor so that sound is able to pass the sensor and exit the sound channel.

The spout has openings 149 at the position of the sensor, so that sound may pass around the sensor via the openings 149. The openings 149 are closed by the dome 20 so that sound cannot escape the sound channel via the openings 149. The dome 20 has a fastening portion 210 which engages the spout, typically an outer portion thereof, including the portion(s) of the spout defining the openings 149, so that the portions 210 seal the openings 149 so that the openings form concavities in the sound channel 148 but so that sound cannot to any significant degree escape the sound channel 148 via the openings 149. The openings 149 thus define widenings of the sound channel.

When the sensor is provided at the position(s) of the opening(s), sound may pass the sensor by travelling inside the opening(s) or cavity/ies defined by the opening(s) so that the sensor may take up more space or the sound may more easily pass due to the increased space or cross sectional area at the opening(s).

As described further below, the opening(s) or each opening 149 may extend, along a longitudinal axis of the spout, from a first position to a second position, between which the extreme portions of the sensor, also when projected on to the longitudinal axis, are provided.

The assembly 20 may be a personal hearing instrument, such as a hearing aid, having an outer housing in which the receiver is provided, optionally together with optional elements, such as battery, processor, other microphones, or the like. The element 146 illustrates a portion forming the outer housing together with the spout element with the spout 14.

Figure 3:
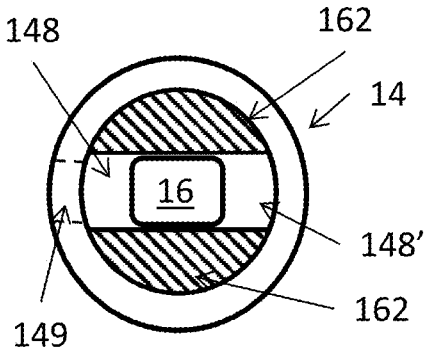
FIG. 3 illustrates the positioning of the sensor in the sound channel.
Figure 4:
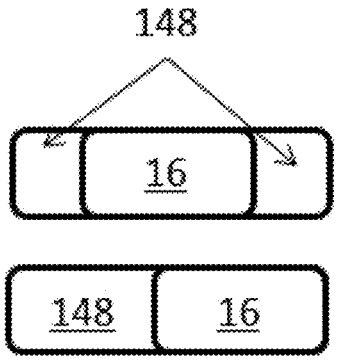
FIG. 4 illustrates different positions of the sensor in the sound channel.

In FIGS. 3 and 4, different positions of the sensor 16 in the sound channel 148 are illustrated. A single opening 149 is illustrated. Two or more may be used if desired. In FIG. 4, the sensor and the sound channel 148 are rectangular. In FIG. 3, the sound channel 148 is circular, where two other elements 162 and 164 are also provided in the sound channel. The elements 162 and 164 may also be sensors or elements for use with a sensor. In one embodiment, the element 162 is an optical emitter and the element 164 is an optical receiver. In that situation, the present assembly is suited for positioning in the ear canal of a person where sensors may be used for a number of purposes. One purpose is to determine the pulse or other physiological signs of a person like blood pressure, heart rate variability or respiration rate, such as using the so-called PPG (photoplethysmography) which relates to absorption, reflection and/or scattering of radiation in the tissue, including blood vessels. On the basis of the radiation received, the pulse or other physiological parameters of the person may be determined, as the absorption, reflection and/or scattering in the tissue will vary with the perfusion of the tissue and expansion/contraction of the blood vessels. Thus, the variation of received radiation will correspond to the physiological parameters of the person like pulse frequency, blood pressure etc.

Clearly, the dome could be made translucent to the relevant wavelength(s). Actually, providing such elements in or at the dome may be advantageous in that very little movement takes place between the ear canal and the optical elements at this position.

In FIG. 3, it is seen that sound channel portions 148' exist which may be used for the sound travelling around the sensor. These may be replaced by or supplemented by they opening(s) 149.

One advantage of providing the sensor in the spout is space saving and allowing smaller dimensions of the assembly. Hitherto, sensors have been provided at the side of the receiver, increasing the cross-sectional area, or at the back or front of the receiver, increasing the length of the assembly. This makes it more difficult to obtain a desired positioning of the assembly in an ear canal of a user.

The spout, however, is often present but empty, and it has been found that the quality and intensity of the sound output by the sound generator is not detrimentally affected, if sufficient space is allowed around the sensor to transport this sound. Very small microphones are available, such as the TDK4064 microphone.

In addition, spouts may have standard sizes whereby it will be easy to provide another type or size of receiver with the sensor without having to redesign the system.

Providing an element in the spout may decrease the volume of the spout, whereby the high frequency parameters of the assembly are affected due to the constricted passage around the sensor. Thus, it may be desired to require that a certain area, in the cross section of the spout, is open along the length of the sensor—and this area may depend on a length of the sensor in the spout. Defining a minimum cross-sectional area which is open along this length will determine the overall effect on the presence on the sensor in the spout.

Clearly, the sensor need not have the same cross section or cross section are along its length along the longitudinal axis of the spout, which need not be straight nor have the same inner cross section or cross-sectional area.

In one example, it has been found that if at least 15% of a spout is left open, the second peak frequency of a Sonion H40UA03 receiver is only reduced by 3%, when the sensor has a length of 2.4 mm. If the sensor has a length of 5 mm, 30% of the cross-sectional area should be left open to achieve the same effect.

Figure 5:
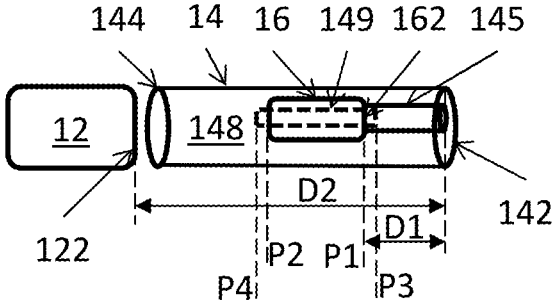
FIG. 5 illustrates the distances in the sound channel.

In FIG. 5, the spout 14 is illustrated with the two openings 142, 144, the sensor 16 therein and the receiver 12 with the sound output 122 opening into the opening 144. Also, the distances D1 and D2 are illustrated from the opening 142 to the sound input 162 and the sound output 122 of the receiver, respectively.

Preferably, the distance between the sound input and the sound output (D2-D1) is as large as possible and preferably at least 2 mm, such as at least 4 mm, such as at least 6 mm.

Also, it is preferred that the distance D1 is as small as possible, as any volume of the spout 14 in front of the sensor may, especially when it is a microphone, affect the signal thereof. Thus, a filtering or adaptation may be desired of the output of the sensor, depending on this volume and thus the distance D1.

In addition, the sound from the receiver has a larger tendency of reaching the sound input, when the distance D1 increases. Again, this may be taken into account in a signal adaptation of the output of the sensor, but reducing the distance D1 is often preferred.

In FIG. 5, a sound guiding element 145 is additionally illustrated. This element may be left out if desired. This element has the function of dividing the sound channel 148 into two sound transport channels, one inside the element 145 and one outside of this element but inside the sound channel. The element 145 guides sound from the opening 142 to the microphone and at the same time guides sound from the receiver to the opening without reaching the microphone. This element thus has the advantage that the sound from the sound generator does not unintentionally reach the microphone.

This element 145 may be designed in many manners. In another embodiment, the element 145 may form a wall inside the spout again dividing the sound channel into sound transport channels.

Naturally, the element 145 may engage the microphone and extend to the opening 142. Alternatively, the element 145 need extend only a portion of the distance to the opening—but may also extend out of the opening 142.

FIG. 5 also illustrates the position of the receiver 16 and an opening 149 within the sound channel. The receiver extends between positions P1 and P2 along the longitudinal direction, which may be an axis of symmetry, of the sound channel 148. An opening 149 extends between positions P3 and P4, and it is seen that the positions P1 and P2 are provided between the positions P3 and P4, so that sound may pass the receiver in the sound channel even in the situation where the receiver takes up all space in the cross section of sound channel (not including the opening 149). The sound channel has (see FIG. 3) an inner cross section and has the opening 149 defined as an opening in the wall and thus not forming part of the definition of the inner cross section.

If the opening 149 was instead positioned so that one or both of the positions was between P1 and P2, sound would only be able to enter the opening if it was able to travel around at least part of the receive within the sound channel 148.

The invention claimed is:

1. An assembly of:

a sound generator having a sound output, a spout connected to the sound generator, the spout having a sound channel configured to guide sound away from the sound generator, the sound channel having a first opening, connected to the sound output, and a second opening, —a sensor positioned in the sound channel, and a dome attached to the spout, wherein:

the spout has one or more third openings between the first opening and the second opening, the sensor is positioned in the sound channel at the third opening(s), and the dome has a fastening portion engaging the spout and blocking the third opening(s).

2. The assembly according to claim 1, wherein one or more sound passages are provided in the sound channel around the sensor.

3. The assembly according to claim 1, wherein the sensor is generally box-shaped with at least 4 at least substantially plane surfaces and wherein sound passages extend at least 2 of the at least 4 at least substantially plane surfaces.

4. The assembly according to claim 1, wherein the sensor is generally box-shaped and has a longitudinal axis at least substantially parallel to a longitudinal axis of the spout.

5. The assembly according to claim 1, wherein the sensor is a microphone having a sound input.

6. The assembly according to claim 5, wherein a distance of at least 2 mm exists, along the sound channel, between the sound output and the sound input.

7. The assembly according to claim 5, wherein a first distance exists, along the sound channel, from the second opening to the sound input and a second distance exists, along the sound channel, between the second opening and the sound output, wherein the second distance is at least 2 times the first distance.

8. The assembly according to claim 7, wherein the second distance is at least 6 mm longer than the first distance, and where, at all longitudinal positions of the spout where the sensor is present, the sensor covers an area of no more than 95% of an inner cross sectional area of the spout at the longitudinal positions.

9. The assembly according to claim 7, wherein the first distance is no more than 3 mm.

10. The assembly according to claim 5, wherein the spout comprises at least two separate sound transport channels, one sound transport channel of the two separate sound transport channels extending from the second opening to the sound output and another sound transport channel of the two separate sound transport channels extending from the second opening to the microphone.

11. The assembly according to claim 1, wherein, along a longitudinal axis of the sound channel:

the sensor is positioned between a first position and a second position and a third opening is positioned between a third position and a fourth position, wherein the first and second positions are provided between the third and fourth positions.

12. The assembly according to claim 1, further comprising an assembly housing, the sound generator being provided in the assembly housing and the spout being part of the assembly housing.

13. A Receiver in the Canal element comprising an assembly according to claim 1.

14. A personal hearing device comprising an assembly according to claim 1.

15. A method of providing an assembly according to claim 1, the method comprising:

providing a sound generator having a sound output, attaching a spout to the sound generator at the sound output, and providing a sensor in the spout.

* * * * *